US007663485B2

(12) United States Patent
Kim et al.

(10) Patent No.: US 7,663,485 B2
(45) Date of Patent: Feb. 16, 2010

(54) APPARATUS FOR IDENTIFYING OBJECTS USING RADIO FREQUENCY AND APPARATUS AND METHOD FOR TRACKING POSITION OF OBJECT USING THE SAME

(75) Inventors: Young Woo Kim, Daejeon (KR); Kyoung Park, Daejeon (KR); Seong Woon Kim, Daejeon (KR); Myung Joon Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 436 days.

(21) Appl. No.: 11/295,773

(22) Filed: Dec. 7, 2005

(65) Prior Publication Data

US 2006/0273903 A1 Dec. 7, 2006

(30) Foreign Application Priority Data

Jun. 3, 2005 (KR) ..... 10-2005-0047919

(51) Int. Cl.
*G08B 13/14* (2006.01)

(52) U.S. Cl. ..... 340/572.1; 340/539.22; 340/825.49; 340/10.1

(58) Field of Classification Search ... 340/572.1–572.9, 340/568.1, 10.1, 505, 501, 825.35, 825.49, 340/539.1, 539.22, 539.26, 539.11
See application file for complete search history.

(56) References Cited

U.S. PATENT DOCUMENTS

| | | | | |
|---|---|---|---|---|
| 6,750,769 | B1 * | 6/2004 | Smith | 340/572.1 |
| 7,079,034 | B2 * | 7/2006 | Stilp | 340/573.1 |
| 7,199,712 | B2 * | 4/2007 | Tafas et al. | 340/572.1 |
| 7,199,725 | B2 * | 4/2007 | Gilfix et al. | 340/825.19 |
| 7,221,269 | B2 * | 5/2007 | Onderko et al. | 340/539.13 |
| 7,289,903 | B2 * | 10/2007 | Adamczyk et al. | 701/207 |
| 2004/0153671 | A1 * | 8/2004 | Schuyler et al. | 713/201 |
| 2004/0160317 | A1 * | 8/2004 | McKeown et al. | 340/522 |
| 2005/0200453 | A1 * | 9/2005 | Turner et al. | 340/5.61 |
| 2005/0246248 | A1 * | 11/2005 | Vesuna | 705/28 |
| 2006/0066449 | A1 * | 3/2006 | Johnson | 340/539.12 |

FOREIGN PATENT DOCUMENTS

| | | |
|---|---|---|
| JP | 11-236240 | 8/1999 |
| JP | 2002-058648 | 2/2002 |
| JP | 2002-132886 | 5/2002 |
| KR | 1020010036623 | 5/2001 |
| KR | 20030064686 | 8/2003 |
| KR | 1020030080436 | 10/2003 |
| KR | 1020050121046 | 12/2005 |

* cited by examiner

*Primary Examiner*—Daniel Previl
(74) *Attorney, Agent, or Firm*—Ladas & Parry LLP

(57) ABSTRACT

A radio frequency identification (RFID) tag based object position tracking apparatus and method are provided. The apparatus includes a position recognizer including at least one radio frequency identification unit for reading information data on an object through a sensor; and a path analyzing and processing unit for allocating each unique coordinates to the radio frequency identification units based on a relative position in a space where a position recognizer is disposed and recognizing the position of the object and analyzing the path based on the object information data received by the sensor in the radio frequency identification unit corresponding to the unique coordinate. Thus, it is possible to track the path of an object with a low density of RFID tags.

7 Claims, 5 Drawing Sheets

FIG. 4

| | | | | | | | | | | | | | | | | | |
|---|---|---|---|---|---|---|---|---|---|---|---|---|---|---|---|---|---|
| AA | AB | AC | AD | AE | AF | AG | AH | AI | AJ | AK | AL | AM | AN | AO | AP | AQ | AR |
| BA | BB | BC | BD | BE | BF | BG | BH | BI | BJ | BK | BL | BM | BN | BO | BP | BQ | BR |
| CA | CB | CC | CD | CE | CF | CG | CH | CI | CJ | CK | CL | CM | CN | CO | CP | CQ | CR |
| DA | DB | DC | DD | DE | DF | DG | DH | DI | DJ | DK | DL | DM | DN | DO | DP | DQ | DR |
| | | | | | | EG | EH | EI | EJ | EK | EL | EM | EN | EO | EP | EQ | ER |
| | | | | | | FG | FH | FI | FJ | FK | FL | FM | FN | FO | FP | FQ | FR |
| | | | | | | GG | GH | GI | GJ | GK | GL | GM | | | | | |
| | | | | | | HG | HH | HI | HJ | HK | HL | HM | | | | | |
| | | | | | | IG | IH | II | IJ | IK | IL | IM | | | | | |

APPARATUS FOR IDENTIFYING OBJECTS USING RADIO FREQUENCY AND APPARATUS AND METHOD FOR TRACKING POSITION OF OBJECT USING THE SAME

CROSS-REFERENCE TO RELATED PATENT APPLICATION

This application claims the benefit of Korean Patent Application No. 10-2005-0047919, filed on Jun. 3, 2005, in the Korean Intellectual Property Office, the disclosure of which is incorporated herein in its entirety by reference.

BACKGROUND OF THE INVENTION

1. Field of the Invention

The present invention relates to an apparatus and method for detecting the position of an object. More particularly, the present invention relates to an apparatus and method for analyzing the position and path of an object through radio frequency identification (RFID) having a sensor.

2. Description of the Related Art

Conventional techniques of identifying the position of a moving object that has been proposed include a technique of tracking the position of the object by assigning an identifiable mark to the object and imaging and reading the moving object using a video camera, a technique of tracking the position of an object based on whether the moving object passes a specific position using an optical or physical sensor when the moving object reaches the specific position, a technique of tracking the movement of the object by attaching a radio frequency identification (RFID) tag to the moving object and disposing a plurality of RFID readers in several positions, etc.

The conventional video camera based method requires a complex process to analyze an image. The method requires expensive equipment performing a number of operations and also requires many pieces of equipment allowing object tracking in several positions since the method can be used to identify only the position in a limited area displayed on a screen.

Among the conventional position tracking techniques, the technique of identifying the position of the moving object based on whether the moving object passes a specific position can be used to identify the object moving from one position to a next position, but it is difficult to recognize intermediate movement of the object.

A position tracking system based on RFID has less restrictions on position track and places since RFID tags are disposed in a moving object and RFID readers disposed at several positions, but more expensive RFID readers are required compared to RFID tags.

U.S. Pat. No. 6,750,769 B1 in the name of Sun Microsystems Inc., entitled "Method and Apparatus for Using RFID Tags to Determine the Position of an Object," describes a system of identifying the position and shape of an object disposed on a floor having an array of RFID tags in a limited area. The system determines the position and shape of the object by using the fact that an RFID reader cannot receive signals from RFID tags of the array in a region where the object is disposed on the floor.

In the foregoing patent, since identification of the position and shape of the object positioned on the array is based on information from RFID tags blocked by the object, when the RFID tags are disposed in a spare array, it is difficult to obtain the exact shape and position of the object since position information can be missed. Therefore, the RFID tags must form a dense array to identify the position and shape of the object.

SUMMARY OF THE INVENTION

The present invention provides an object position tracking apparatus and method for analyzing the position and path information of an object with a less density of RFID tags through RFID having a sensor.

According to an aspect of the present invention, there is provided an apparatus for identifying objects using radio frequency comprising: a sensor for sensing objects in a predetermined area; a data converter for converting information from the sensor into digital information; a radio recognition tag having unique identification information; and a transmitter for transmitting the digital information from the data converter with the unique identification information of the radio recognition tag.

According to another aspect of the present invention, there is provided an apparatus for tracking the position of an object, the apparatus comprising: at least one radio frequency identification unit comprising a sensor and a radio recognition tag and transmitting digital information with unique identification information of the radio recognition tag, the digital information being obtained by digitizing information from the sensor; and a path analyzing unit for allocating a unique coordinates to the at least one radio frequency identification unit based on a relative position within the at least one radio frequency identification unit, and for recognizing the position of the object and analyzing the path of the object based on the digital information and the unique identification information.

According to yet another aspect of the present invention, there is provided a radio frequency identification (RFID) sensing method including sensing objects in a predetermined area; converting information on the sensed object into digital information; and transmitting the digital information with unique identification information of a radio recognition tag.

According to yet another aspect of the present invention, there is provided an object position tracking method including disposing at least one sensor for sensing an object in a predetermined area with at least one radio recognition tag including unique identification information, and allocating a unique coordinate to each of the sensors depending on the relative positions of the sensors; receiving the unique identification information and digital information obtained by digitizing information from the sensor; and recognizing the position of the object and analyzing the path of the object based on the digital information and the allocated unique coordinate.

BRIEF DESCRIPTION OF THE DRAWINGS

The above and other features and advantages of the present invention will become more apparent by describing in detail exemplary embodiments thereof with reference to the attached drawings in which:

FIG. 4 illustrates the path of an object moving over a plurality of radio frequency identification units.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as being limited to the embodiments set forth herein. Rather, these embodiments are provided so that this disclosure will be thorough and complete, and will fully convey the scope of the invention to those skilled in the art.

Radio frequency identification (RFID) is a technique of automatically identifying an object, such as a person or a product, using a radio frequency. That is, RFID is a radio recognition technique in which a reader automatically recognizes data stored in a tag, a label, a card, etc. having a micro chip therein producing an electromagnetic wave with a radio frequency.

The RFID technique is regarded as an essential technique in a ubiquitous environment as storage and recognition capabilities of chips improve. The RFID technique is widely used as a technique for overcoming shortcomings of existing bar cards or magnetic recognition devices or substituting them.

Figure 1:
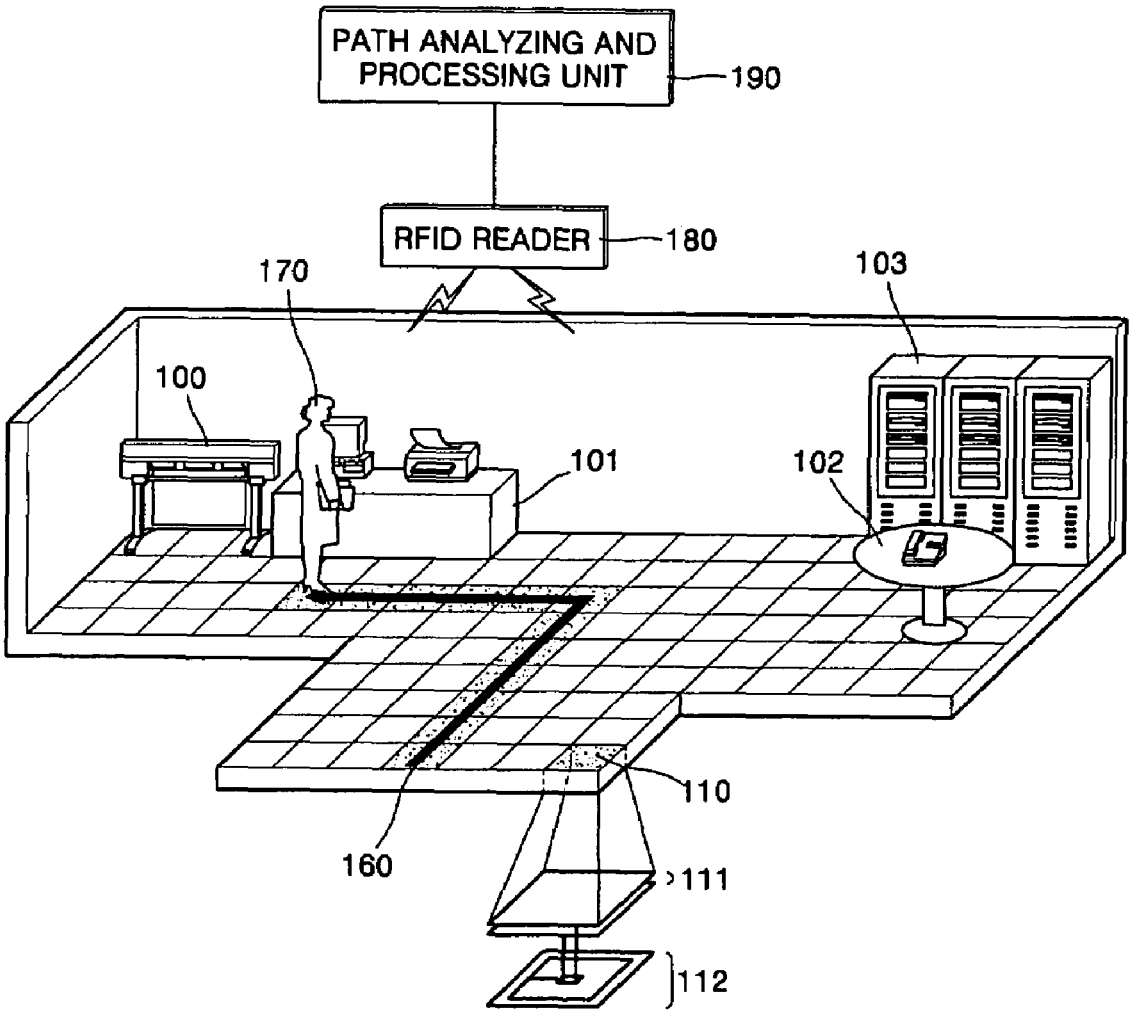
FIG. 1 illustrates the configuration of a radio frequency identification (RFID) based moving object position tracking system according to an embodiment of the present invention.

FIG. 1 illustrates the configuration of an RFID based moving object position tracking system according to an embodiment of the present invention.

Referring to FIG. 1, the RFID tag-based moving object position tracking apparatus according to an embodiment of the present invention includes at least one Radio frequency identification unit 110, an RFID reader 180, and a path analyzing and processing unit 190.

The radio frequency identification unit 110 can be composed of a sensor unit 111 and an identifying unit 112. The identifying unit 112 includes an RFID tag, an antenna and a data converter.

The radio frequency identification unit 110 senses movement of an object 170 with the sensor 111 and transmits sensing information and unique identification information of the radio recognition tag through the antenna. A detailed description of the radio frequency identification unit 110 will be described later in greater detail with reference to FIGS. 2, 3A and 3B.

The RFID reader 180 performs (controls) reading and writing from and to the RFID tag. The RFID reader 180 comprises an antenna. The antenna is configured to receive data stored in the tag using a defined frequency and protocol.

In fact, the RFID reader 180 can receive the identification information unique to the radio recognition tag and the information from the radio frequency identification unit 110, read information from a card corresponding to the RFID tags and supply power.

After reading the tag information, the RFID reader 180 transmits the read tag information to the path analyzing and processing unit 190.

The path analyzing and processing unit 190 may include a computer. However, it will be apparent to those skilled in the art that the path analyzing and processing unit 190 is not limited to the computer, and may be substituted and modified by and into an equivalent component without departing from the spirit of the present invention.

The path analyzing and processing unit 190 recognizes the number of the RFID tags based on the sensing information and the unique identification information of the radio recognition tags, which are received from the RFID reader 180.

The path analyzing and processing unit 190 then allocates a unique coordinate to each of the radio frequency identification units 110 based on the relative positions within the radio frequency identification units 110.

If there is a change in the received sensing information, the RFID reader 180 transmits the changed sensing information together with the unique identification information of the radio recognition tags to the path analyzing and processing unit 190. The path analyzing and processing unit 190 analyzes the path of the object by recognizing the allocated unique coordinates of the radio frequency identification units corresponding to the unique identification information of the radio recognition tags.

Figure 2:
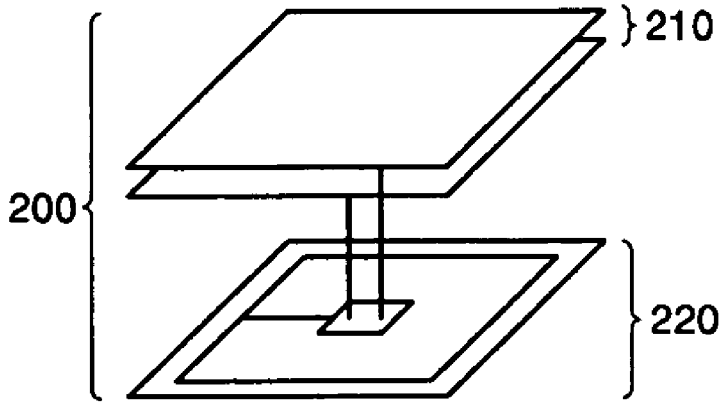
FIG. 2 illustrates the configuration of a radio frequency identification unit according to an embodiment of the present invention.
Figure 2:
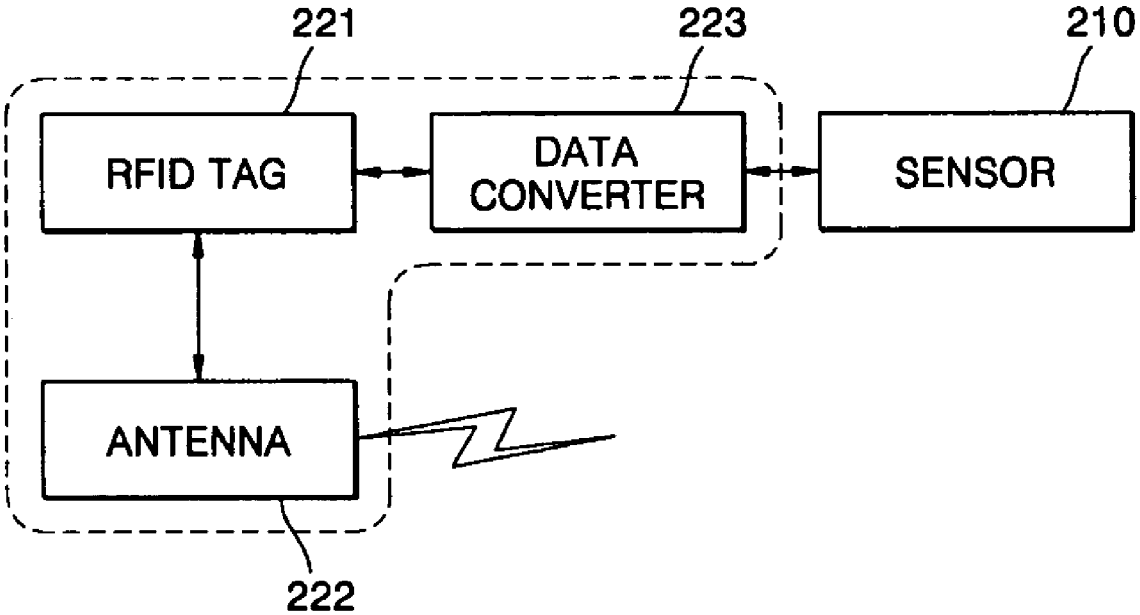

FIG. 2 illustrates the configuration of the radio frequency identification unit according to an embodiment of the present invention.

The radio frequency identification unit 200 includes a sensing unit 210 and an identifying unit 220.

The sensing unit 210 senses the presence of the object over a wide area. Sensors used in the sensing unit 210 are not limited in type and number. That is, examples of the sensors used to recognize the position of the object include pressure sensors, temperature sensors, and magnetic sensors. However, the sensor is not limited to the above-described sensors.

The identifying unit 220 includes an RFID tag 221, an antenna 222 and a data converter 223.

The RFID tag 221 includes a low power IC circuit. The RFID tag 221 communicates data with the RFID reader via the antenna 222. The RFID simultaneously recognizes several tags in a non-contact manner and is able to do that while in moving in a certain distance. And RFID signal can pass through an obstacle.

The identifying unit 220 receives a change in object information data received from the sensing unit 210, converts the data into digital data, performs a basic RFID operation based on the unique identification information of the RFID tag 221, and then transmits the information obtained by converting the object information data to the digital and the unique identification information of the RFID tag 221 via the antenna 222.

The identifying unit 220 communicates information with the RFID reader 180 of FIG. 1 through radio wave. The RFID tag 221, called an RFID transponder, of the identifying unit 220 communicates information with the RFID reader 180, specifically, with a microchip storing an identification code of the object and other information associated with the object, via the antenna 222 through radio wave.

The RFID reader 180 also sends the information from the radio frequency identification unit 110 to the path analyzing and processing unit 190 and from the path analyzing and processing unit 190 to the radio frequency identification unit 110.

Figure 3A:
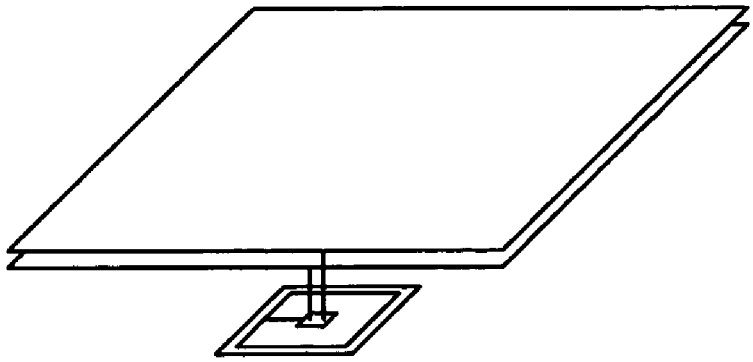
FIGS. 3A and 3B show a sensing range of the radio frequency identification unit illustrated in FIG. 2.
Figure 3B:
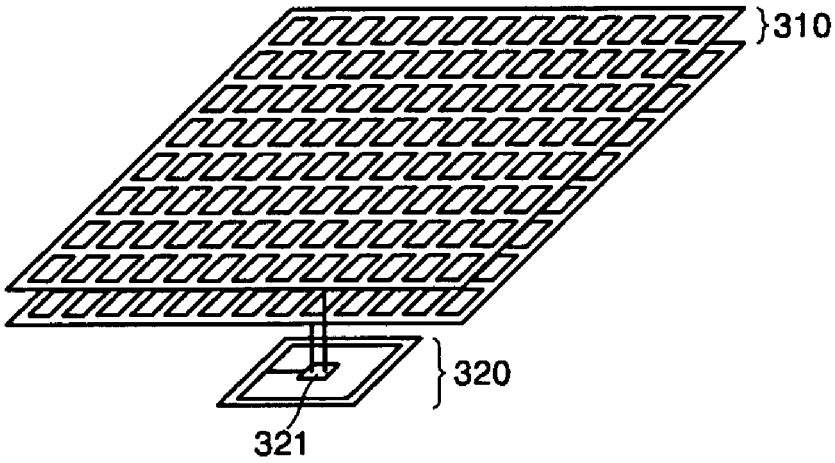

FIGS. 3A and 3B show a sensing range of the radio frequency identification unit 110. According to an embodiment of the present invention, the radio frequency identification unit is a pressure sensor for sensing capacitance.

The sensor 310 is made of two thin metal plates as illustrated in FIG. 3A or of a metal mesh with thin metal stripes as illustrated in FIG. 3B. The sensor 210 is relatively larger than the RFID tag 321.

Figure 3C:
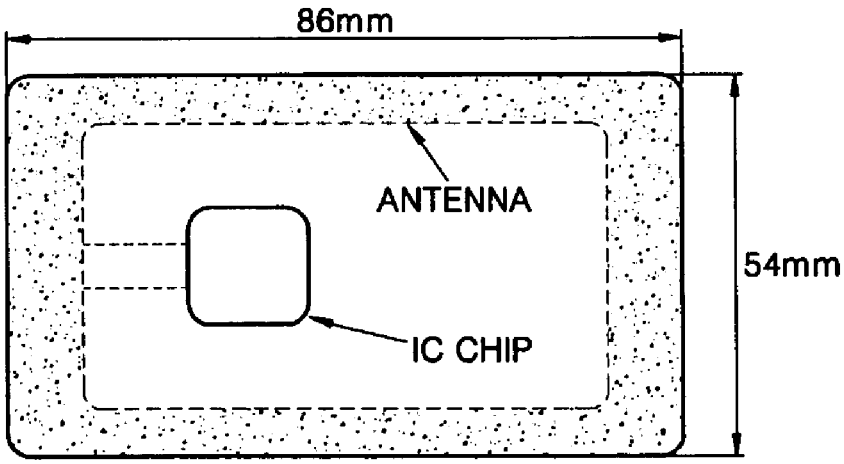
FIG. 3C shows an example of a conventional RFID tag.

As shown in FIG. 3C, an RFID tag is generally very small in size. Because the RFID tag including an antenna transmitting and receiving radio frequencies is small, a number of tags are required to track the position of the object.

However, FIG. 3C illustrates only an embodiment of a typical RFID tags and is not intended to provide a limit to the size and shape of the RFID tag of present invention.

The RFID based moving object position tracking system according to an embodiment of the present invention includes a sensing unit 210 for tracking the position of an object, such that a moving range of an object that can be tracked by the radio frequency identification unit 110 is increased depending on a sensible range of the sensing unit 210 as shown in FIGS. 3A and 3B (e.g., more than several tens of $cm^2$), thereby reducing the number of the RFID tags.

In an embodiment of the present invention, the size of the sensing unit 210 is 10 $cm^2$ and the size of a pressure sensing device capable of sensing pressure by sensing a change in capacitance is 900 $cm^2$ (30 cm×30 cm).

According to an embodiment of the present invention, a total of 100 RFID tags 221 are required to track the position of a moving object, such as a person in a space of 9 $m^2$ (90,000 $cm^2$). By disposing the 100 RFID tags adjacent to each other on the floor and measuring a change in data from the pressure sensor caused by object movement, the position and the movement of the object are recognized. On the other hand, in U.S. Pat. No. 6,750,769 B1 in the name of Sun Microsystems Inc., describing a method of determining RFID tags blocked by an object, about 330 RFID tags are required when the surface area of the bottom of a foot of a person is 270 $cm^2$ (10 cm×27 cm).

By using the RFID based moving object position tracking system, it is possible to reduce the density of the RFID tags 221 by using the radio frequency identification units 110 each including one of the sensing units 210.

FIG. 4 illustrates the path of the object moving over a plurality of radio frequency identification units.

To prepare in the radio frequency identification unit, an array of radio recognition tags may be embedded in a roll of floor paper and the roll cut to a certain size, or radio recognition tags may be embedded in individual tiles laid down. However, these are just suggestions and are in the way intended to limit the technical scope of the present invention.

The RFID tags have unique identification information for identifying the respective RFID tags. The radio frequency identification units each having a sensor are positioned (embedded) in the floor at uniform intervals and then the unique identification information is initially received from the RFID tag of each of the radio frequency identification units by an RFID reader.

A unique coordinate is then allocated to each of the radio frequency identification units including the RFID tags based on its relative position. Based on the coordinates, it is possible to confirm the location of the RFID tags.

Once the coordinates are mapped, the RFID tag senses through the sensor a change in the sensor data according to the movement of the object over the radio frequency identification units, and transmits the changed data together with the information on the RFID tag via the antenna. The RFID reader receives information from all the RFID tags.

The path analyzing and processing unit 190 compares the sensor data received from each of the RFID tags to previous sensor data (a pressure change from a pressure sensor or a temperature change from a temperature sensor) to determine which of the RF sensing units the moving object is disposed on and recognize the position of the object by determining to which the radio frequency identification units on which the object is disposed are allocated.

Figure 5:
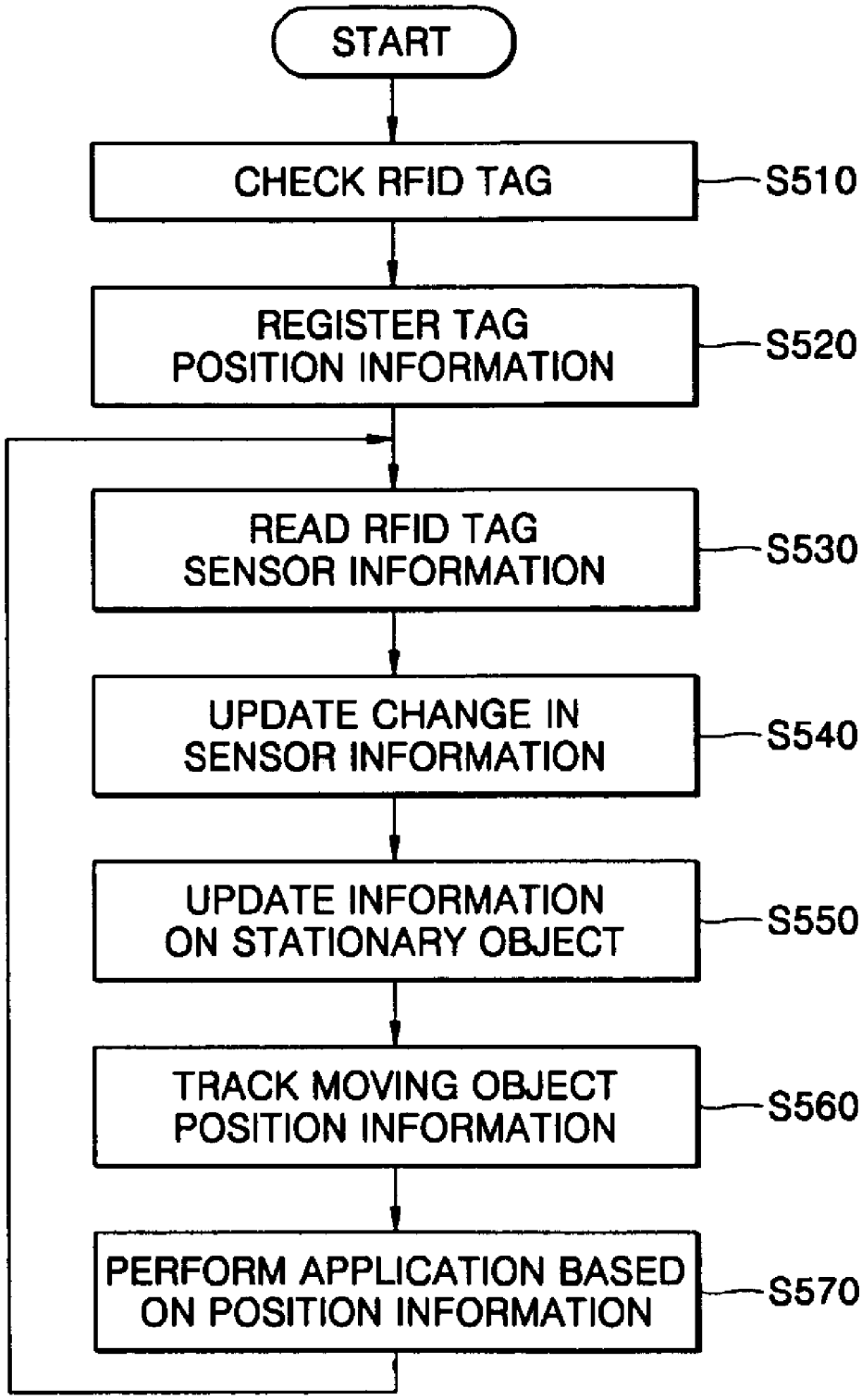
FIG. 5 is a flowchart illustrating a RFID based moving object position tracking method according to an embodiment of the present invention.

FIG. 5 is a flowchart illustrating an RFID based moving object position tracking method according to an embodiment of the present invention.

To analyze the position and path of the object according to an embodiment of the present invention, a radio frequency identification unit checks unique identification information of an RFID tag through the initialization of the RFID tag (S510).

Thereafter, a position recognizer allocates a unique coordinates to each of the radio frequency identification units depending on the relative position within the radio frequency identification unit and registers position information for the unique identification information of the RFID tags (S520).

After the initialization process (S510 and S520) is completed, an object position and path analyzing apparatus frequently reads object information data from the sensor and analyzes the presence of an object and the path of the object. To this end, the path analyzing and processing unit (e.g., a computer) determines a change in object information data read by the radio frequency identification unit using an RFID reader (S530). The path analyzing and processing unit updates the object information based on the change in the object information data (S540).

The object position information is divided into stationary object information and moving object information. If there is no change in the object information data for a long time, the object is regarded as a stationary object. If the object information data read by the sensor is changed within a short time, the object is regarded as a moving object and the position change information is updated to track the position of the object (S550 and S560).

The updated object information data and the object position change information are subject to various application operation performed by an application program embedded in the path analyzing unit (e.g., a computer), and then information is repeatedly acquired from the sensor (S570).

With the sensor based object position and path analyzing apparatus according to an embodiment of the present invention, it is possible to perform various tasks. Examples of possible applications include recognition of the path of moving object based on position tracking, situation recognition and reaction, and a security application in a limited region through position tracking.

FIG. 1 shows an example of tracking the position of a moving object 170. When the moving object (in this example, a computer manager) moves to a specified place along a specific path in a certain space (in this example, an office environment), the path of the moving object is recognized and a specific operation is performed based on the recognized information (in this example, a computer is turned on).

As shown in FIG. 1, the moving object 170 has moved along a certain path 160 and stationary objects 100, 101, 102 and 103 are located after the RFID tags in the radio frequency identification units are initialized.

FIG. 4 illustrates an analyzed path of the moving object. The object position recognizing and path analyzing apparatus is able to recognize that there are objects fixed at AA, AC, AD, AE, AF, AG, AO, AP, AQ, AR and DQ and the moving object of FIG. 1 has moved along a path of IJ→HJ→FJ→EJ→DJ→CJ→CI→ . . . →CD after the RFID tags in the radio frequency identification units are initialized.

The present invention is also capable of being implemented as a computer-readable code on a computer readable recording medium. The computer readable recording medium includes all kinds of recording apparatuses in which computer system-readable data is stored. Examples of the computer readable recording medium include a ROM, a RAM, a CD-ROM, a magnetic tape, a floppy disk and an optical data storage apparatus. The computer readable recording medium also includes a carrier wave, e.g., a form of transmission over the Internet. The computer-readable recording medium is also distributed to computer systems connected over a network and computer-recordable codes may be stored and executed in a distributed manner.

According to the present invention, the apparatus and method for analyzing the position and path of an object using RFID tags having sensors can be used to track the path of an object with a low density of RFID tags.

In addition, it is possible to identify between a stationary object and a moving object based on a change in object information data read through the sensor in a limited area. Therefore, the present invention can be applied to a situation recognition system or security.

It is also possible to recognize an exact change in the position of an object and various information on features of the object by sensing the object with the sensors.

In addition, the present invention is economically advantageous since the number of required tags is reduced as an embedded sensor in a radio frequency identification unit has a greater sensing area than the RFID tag by itself.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus for tracking the position of an object, the apparatus comprising:

at least one radio frequency identification unit comprising:

a sensor for sensing the presence of the object;

a radio recognition tag having unique identification information; and a transmitter for transmitting digital information with the unique identification information of the radio recognition tag, the digital information being obtained by digitizing information from the sensor; and a path analyzing unit for allocating unique coordinates to the at least one radio frequency identification unit based on a relative position within the at least one radio frequency identification unit, and for recognizing the position of the object and analyzing the path of the object based on the digital information and the unique identification information, and wherein the at least one radio frequency identification unit is maintained in a fixed location in respect to the path analyzing unit to sense the presence or non-presence of the object in a predetermined area.

2. The apparatus according to claim 1, wherein the path analyzing unit identifies between a stationary object and a moving object based on whether the information from the sensor changes within a predetermined period of time.

3. The apparatus according to claim 1, wherein the path analyzing unit comprises an RFID reader that receives the digital information and the unique identification information via a radio frequency.

4. The apparatus according to claim 3, wherein with the information from the sensor in radio frequency identification unit changed, the path analyzing unit analyzes the path of the object by determining the unique coordinates allocated to the radio frequency identification unit, wherein the unique coordinates allocated to the radio frequency identification unit including the sensor one-to-one corresponds to the unique identification information of the radio recognition tag in the radio frequency identification unit.

5. An object position tracking method comprising:

disposing at least one radio frequency identification unit having at least one sensor for sensing the presence or non-presence of objects in a predetermined area with at least one radio recognition tag including unique identification information;

allocating a unique coordinate to each of the radio frequency identification units depending on the relative fixed positions of the radio frequency identification units;

digitizing sensed information from the sensor of the radio frequency identification unit;

receiving the unique identification information and the digitized sensed information; and recognizing the position of the object and analyzing the path of the object based on the digitized sensed information indicating the presence or non-presence of the object in the predetermined area associated with the allocated unique coordinate.

6. The method according to claim 5, wherein the recognizing the position of the object and analyzing the path of the object comprises identifying a stationary object and a moving object based on whether the object sensing information changes within a predetermined period of time.

7. The method according to claim 6, wherein the recognizing the position of the object and analyzing the path of the object comprises analyzing the path of the object by recognizing the unique coordinate allocated to the RFID tag corresponding to the sensor that indicates a change in the sensing information.

* * * * *